US006422558B1

(12) United States Patent
Chambers

(10) Patent No.: US 6,422,558 B1
(45) Date of Patent: Jul. 23, 2002

(54) METHOD OF INTERACTION USING GAME PIECE

(76) Inventor: Kyla J. Chambers, 29500 Healthercliff Rd., #224, Malibu, CA (US) 90265

( * ) Notice: Subject to any disclaimer, the term of this patent is extended or adjusted under 35 U.S.C. 154(b) by 0 days.

(21) Appl. No.: 09/492,878

(22) Filed: Jan. 25, 2000

(51) Int. Cl.[7] ..... A63F 9/04

(52) U.S. Cl. ..... 273/146; 273/440; D21/372; 434/236

(58) Field of Search ..... 273/146, 236, 273/440; D21/372; 434/236

(56) References Cited

U.S. PATENT DOCUMENTS

| | | | | |
|---|---|---|---|---|
| 185,889 | A | | 1/1877 | Boorman |
| 1,505,390 | A | | 8/1924 | Hamilton et al. |
| 1,517,113 | A | | 11/1924 | Greene |
| 1,539,895 | A | | 6/1925 | Buzza |
| 1,562,866 | A | | 11/1925 | Burgess |
| 1,587,580 | A | | 6/1926 | Dutton ..... 273/146 |
| 1,702,760 | A | | 2/1929 | Bradley ..... 273/146 |
| D155,315 | S | | 9/1949 | Peukert ..... D34/5 |
| 3,608,905 | A | | 9/1971 | Edison ..... 273/146 |
| D244,560 | S | | 5/1977 | Derrington ..... D34/15 EE |
| 4,030,210 | A | | 6/1977 | Stebbins et al. ..... 35/20 |
| 4,124,881 | A | | 11/1978 | Haber et al. ..... 362/253 |
| 4,735,419 | A | | 4/1988 | Koca ..... 273/292 |
| 4,736,954 | A | * | 4/1988 | Haney ..... 273/236 |
| D306,470 | S | | 3/1990 | Norman et al. ..... D21/204 |
| 4,927,147 | A | * | 5/1990 | Delzio ..... 273/146 |
| 5,342,059 | A | | 8/1994 | Briem et al. ..... 273/277 |
| 5,511,782 | A | | 4/1996 | Maley ..... 273/93 R |
| 5,909,874 | A | | 6/1999 | Daniel et al. ..... 273/146 |
| 5,918,881 | A | | 7/1999 | Kirby ..... 273/146 |

* cited by examiner

*Primary Examiner*—Benjamin H. Layno
(74) *Attorney, Agent, or Firm*—Cislo & Thomas LLP

(57) ABSTRACT

A method for initiating interaction between clients and psychological therapists, social workers or family mediators, as well as initiating interaction in other social settings, such as in parlor games or the like, where members may otherwise be inhibited from interaction with a central character or with other members. The method utilizes one or more game pieces having patches distributed about surface (s) of the game piece(s). The patches correspond to general topics for discussion or issue-related topics, depending on the make up and purpose of the group of participants. The game pieces are then tossed to a participant, rolled across a floor or table, or thrown at a wall or receiving board whereby one patch per game piece is displayed and the identified participant is required to discuss or react to the topic corresponding to the displayed patch(es).

4 Claims, 1 Drawing Sheet

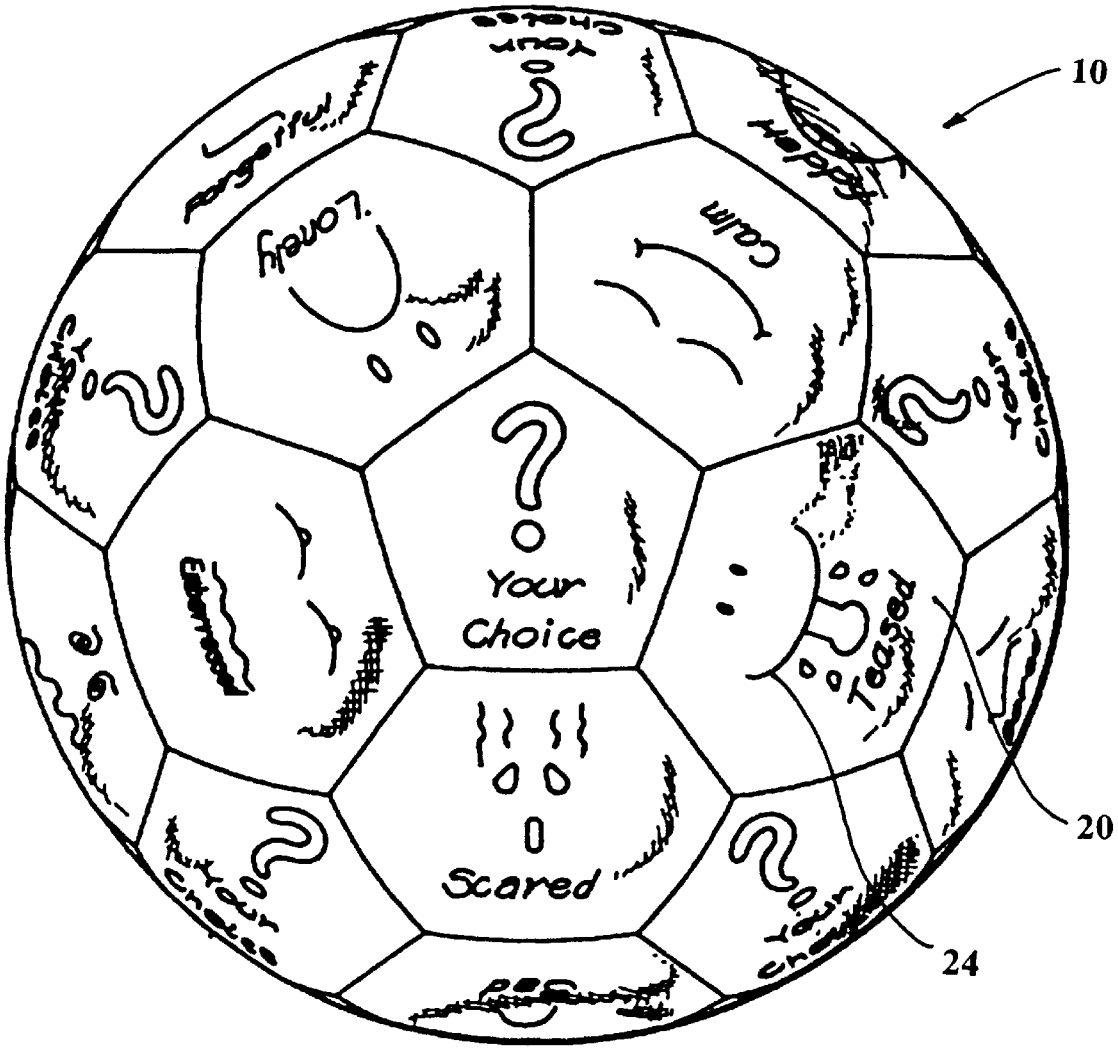
Your Choice
Scared
Your Choice
Your Choice
Your Choice

METHOD OF INTERACTION USING GAME PIECE

BACKGROUND OF THE INVENTION

Field of the Invention

This invention relates to methods for initiating interaction between clients and psychological therapists, social workers or family mediators, as well as initiating interaction in other social settings, such as in parlor games or the like, where members may otherwise be inhibited from interaction with a central character or with other members.

SUMMARY OF THE INVENTION

As a Marriage and Family Therapist, I encountered several difficulties in the field of therapy. I found that therapy was limited to a sterile question and answer session, reducing down to a guessing game. The image of Freud's clients laying on a couch not facing him and delving as far as their memory would allow. The most often asked question being, "How does that make you feel?" and "then how did you feel?"

Unfortunately most children, teens and adults have a hard time connecting with how they feel, let alone with their behaviors and the consequences of those behaviors and choices. Needless to say, I was frustrated with the sterile therapy process.

I began to incorporate play therapy into my sessions. Play therapy creates a safe environment in which children, adults and the elderly feel free to express the way they feel with the aid of play materials such as, sand tray, art, board games (checkers, chess) and ping pong. Play therapy was defined by the International Association of Play Therapy as "the systematic use of a theoretical model to establish an interpersonal process wherein trained play therapists use the therapeutic powers of play to help clients prevent or resolve psychosocial difficulties and achieve optimal growth and development" (APT, 1999, p. 7).

Another way to describe Play therapy is as follows: For children, play is their natural way of expression. Children are able to demonstrate through play their strongest emotions in a way that is safe and instrumental in facilitating a solution or developing coping strategies that further growth and development.

The usual games such as sand tray and ping pong were still cold, rigid, limiting and threatening. Therefore, I developed the Interaction Ball to have a starting point for children, teens, adults and elderly to interact with themselves and each another in a fun non-threatening way. The Interaction Ball may be designed as a soft cuddly item which can be hugged if the person does not want to discuss feelings and behaviors outloud (no words are necessary). Metaphorically, the Interaction Ball brings the intangible (emotions) to a tangible state through a tangible medium. Participants can thus hold their emotions in the palm of their hands and relate to them on a conscious level. Therefore, being non-threatening and in a play situation, the Interaction Ball can also be translated into a game situation. A game where everyone can participate and benefit from playing. Play does not begin and end in the therapy office. The Interaction Ball can be easily used in family homes as a parlor game allowing for families to interact with one another. We all feel and act or react to situations; allowing them to be stated in a fun way is one avenue to bring cohesiveness to a group or individual.

The Interaction Ball brings people together that normally would not interact and share feelings and experiences about themselves. Most people are not conducive to expressing their feelings, behaviors and consequences of those behaviors, parents with their children. The Interaction Ball promotes communication and expression of feelings. The Interaction Ball may aid in the ability of a person to verbalize feelings and to express them more comfortably with others, promoting camaraderie and feelings of 'you are not alone.' The Interaction Ball allows for the increased understanding of the affect of feelings and behaviors upon oneself and others, thus making a connection between feelings, behaviors and consequences. It helps people to feel accepted and understood.

BRIEF DESCRIPTION OF THE DRAWING

The drawing is a plan view of a preferred embodiment of the present invention.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and performing the invention in connection with the illustrated embodiments. However, it is to be understood that the same or equivalent functions and sequences may be accomplished by different embodiments that are also intended to be encompassed within the spirit and scope of the invention.

One preferred embodiment of the present invention is illustrated in FIG. 1. It involves a ball or other game piece 10, called herein the "Interaction Ball 10" or the "game piece 10". In this embodiment, the game piece 10 should be of sufficient size and weight to accommodate tossing and/or catching by the players of the game. This embodiment involves a generally round ball with a cloth, leather, or synthetic surface. It may be stuffed with foam, fiber, sand, feathers, or the like, or it may be formed from foam or other synthetic material throughout. Its size could be greater than three (3) inches and less that three (3) feet in diameter, and preferably from about six (6) inches to about fifteen (15) inches in diameter. It can weigh from about two (2) ounces to about five (5) pounds, and preferably from one-half (½) pound to about two (2) pounds.

The cloth surface of this embodiment contains a pattern of images, words, or is phrases 24, and/or colored patches 20 or faces. The patches may be painted regions, separate pieces of cloth, or colored portions, or any other unitary space on the surface or throughout the volume of the game piece 10. Where there are both colored patches and words or images 24, each word or image 24 is typically contained within a single colored patch and does not share that colored patch 20 with any other word or phrase. Where the patches 20 contain words or phrases, the words or phrases could be in any language or multiple languages based on the makeup of the participants. Thus, the game piece 10 may have Spanish words alone or along with English words, or even Braille for use with the blind participants.

The interaction method then involves one player tossing or rolling the game piece 10. This player may be a therapist in a therapy setting or a player designated as the central character in a game setting, or this player may just be some other member of therapy setting or game setting. If this player is a therapist or a central character, then the therapist or central character will indicate which other player will have to respond to the game piece 10. The identified player then catches the game piece 10 or watches it as it otherwise comes to rest.

The response required depends upon the color patch, word or phrase that is displayed when the game piece 10 comes to rest. If the game piece 10 is tossed, and then caught, then the color patch, word or phrase that has come to rest under the catching player's right thumb, for instance, is the designation the is said to have be displayed. If the game piece 10 is rolled, then the color patch, word or phrase that is at the upper most portion of the game piece 10, for instance, when the game piece 10 comes to rest is the designation that is said to be displayed. Of course, the players may agree on some other positioning of the color patch, word or phrase that is said to be displayed, such as the color patch, word or phrase that is covered by the catching player's left index finger or the patch that is most directly stuck to the wall or floor when the game piece 10 comes to rest.

The displayed color patch, word or phrase indicates the topic that the indicated player must discuss. The displayed color patch, word or phrase may indicate the topic either directly according to the definition of the word or phrase or indirectly according to a predetermined index as dictated by the therapist or central character or as agreed upon by the all or a majority of participants.

Another embodiment of the present invention involves one or more game pieces 10 in the shape of multifaceted die, such as a dice having four, six, eight, fourteen, twenty, or thirty-two faces. Each face of the die would be associated with a unique color, word or phrase. The therapist or the indicated player would roll the die on a substantially flat and horizontal surface. The player would then read the upper most faces of the respective die to determine the topic which the player must discuss.

The interaction and interplay would continue with the player or the therapist or central character repeating the above-mentioned steps, namely tossing or rolling the game piece(s) 10 to the next identified player, who in turn is required to discuss the subject(s) displayed as described above. The following list of examples describes variations of this embodiment, all of which are contemplated by the present invention.

EXAMPLE 1

The Interaction Ball 10 has a number of moods (feeling words) written on the surface of the ball with the corresponding color, e.g., happy is yellow, angry is red, calm is blue etc. The fiber filled ball is intended to be tossed from one person to another, and which when caught by the other person designates a particular mood as indicated by a thumb of the other person. The other person either acts out the mood/feeling as in charades, states when was the last time they felt or did not feel that way, or states what makes them feel that mood, such as "I feel X when Y." The group of players may decide before the interplay begins which of these actions are to be taken by the other person. The person guessing correctly at charades is the next person the ball is tossed to. The ball is tossed to a random person when used in the other interaction scenarios.

EXAMPLE 2

The Interaction Ball 10 can be as above but include a cassette tape or recording chip inside the ball which is activated when the ball comes to rest, such as when the person catches the ball or when the ball hits a wall or receiving board, or simply when the rolling motion of the ball slows beyond a certain threshold speed. The activation may occur as the result of pressure being exerted on the particular color patch or word or phrase or as the result of inertial changes being detected by an inertia detection device. The cassette will produce a corresponding sound or noise according to the indicated mood or randomly in the case of the inertia sensor. For example, for the emotion "Happy" the cassette tape may produce a laugh, for "Scared" the cassette tape yelps or screams, and for "Bored" the cassette tape sighs. This can be achieved either through actual vocal recordings or through imitation sounds as by a synthesizer or musical instrument. Also when activated the cassette tape can ask a question to the participants, such as "When was the last time you felt happy," "When did you not feel scared," "What makes you feel calm," or the like.

EXAMPLE 3

A computer game of the Interaction Ball 10 and method can have all the various uses of the ball and writing on the ball as in tangible form. The ball(s) can spin or roll around and land on a particular mood or other word or sentence. The computer will then ask you questions based upon what section of the ball the ball has come to rest upon. The participant will answer the questions either by typing the answer, or the computer will ask multiple choice questions and the participant will click the mouse on the appropriate answer, then the computer will sound the correct noise for a correct response or a different noise for an incorrect response. In the latter embodiment, the participant will want to obtain the correct response and will be anticipating it with the correct answers. The computer will then cause the computerized ball to spin again and the procedure is repeated. The computer could detect and record or store the topic and discussion or response and print the same out upon the request of the therapist or other participant. Additionally, the participant(s) could interact with participants on other computers the conventional global or local computer network communications.

EXAMPLE 4

The Interaction Ball 10 can be used in connection with a board game which could pull almost all of the above-described ways to use the Interaction Ball 10 into one game. Dice-like game pieces 10 are rolled to indicate the number of spaces to move a token on the game board. The game board will be provided with spaces or color patches which may optionally contain words or phrase according to the invention. The spaces would correspond with either various feelings, behavior, embarrassing questions and/or moments, values/morals, or beliefs. The participant would then have to discuss what first comes to mind upon reflecting about the feeling or embarrassing moment upon which his or her token landed. Alternatively, the participant will draw a card from each stack of cards that corresponds to the space or color patch on which his or her token landed. Either the participant will have to answer a question for him or herself, the other participants will have to answer regarding the participant, or the participant will have to act out as in charades and the other participants will have to guess at what they are portraying.

EXAMPLE 5

Any one or more of the examples above could be employed with one or more game pieces 10 having instead specific categories of mood or feeling words, such as embarrassing questions. That is the surface of the game piece(s) 10 could correspond to questions of an embarrassing nature, either each spelled out on the particular color patch, or otherwise indicated in some way by the color patch, such as "Have you ever picked your nose in public," "What is your most embarrassing situation in which you have been caught," or "Tell about your first kiss," or the like.

EXAMPLE 6

Another specific category of phrases or questions could include dating-related questions, such as "When was your first kiss," "Have you been on a blind date," "Have you made love on your first date," or the like.

EXAMPLE 7

Another specific category of phrases or questions could include questions specific to Twelve-Step programs, such as Alcoholics Anonymous, NA, Emotions anonymous, over-eaters anonymous, gamblers anonymous, Alanon, etc. The game piece(s) 10 could have the twelve steps on the ball or other moods and questions regarding and common to the recovery process, such as "What was it like the last time you developed the urge to have a drink," "How did you reward yourself for saying, 'No'," or "How do those around you support your efforts to stay sober?"

EXAMPLE 8

Another specific category of phrases or questions could include questions specific to sexuality or sexual interaction. The patches on the top half of the ball could correspond with action words such as kiss, hug, rub, or the like, while the patches on the bottom half of the ball could correspond to areas of the body such as lips, cheek, eyes, nose etc. Either the participant would have to discuss their likes or dislikes regarding the displayed patch or patches 20.

EXAMPLE 9

Another specific category of phrases or questions could include questions specific to the concerns of girls or women, or of girls of a specific age group, such as pre-teens or early teens. Pre-teen girls are commonly the most difficult subjects to break through to in a meaningful level in a group therapy setting.

Of course, the specific category of phrases or questions could instead include questions specific to the concerns of boys or men, or of boys of a specific age group, such as pre-teens or early teens.

EXAMPLE 10

Alternatively, instead of in the above-mentioned example, the specific category of phrases or questions could aid in initiating interaction in a group setting of both boys and girls of a certain age group wherein the patches on the top half of the game piece 10 are about boys while the patches around the bottom half of the game piece(s) 10 are about girls or the two categories of moods or questions could just be distributed evenly all over the surface of the ball. The benefits of the Interaction Ball(s) 10 then could be to encourage equal participation by both boys and girls in settings which are well known for cause one gender or the other to remain disproportionately silent or removed.

Similarly, the specific category of phrases or questions could aid in initiating interaction in a group setting of boys and/or girls of a separate and distinct age groups wherein the patches on the top half of the game piece(s) 10 are about one age group while the patches on the bottom half of the game piece(s) 10 are about the other age group or the two categories of moods or questions could just be distributed evenly all over the surface of the ball. The questions could be directed to common concerns of members on one age group regarding the other age group.

EXAMPLE 11

Another specific category of phrases or represent actions to be performed either in isolation or with a partner or within the group as a whole. The simplest of these types of actions could be, "Stand on one foot and jump up and down" or "Do ten push ups." More complex social interaction could occur, however, with actions such as "Clean up the play room along with two partners who you can select from the group" or "Direct the group to do some activity without using any words."

EXAMPLE 12

Any one or more of the examples described above could be employed but wherein the participant will catch the ball or game piece 10 and thereby indicate either an action or feeling then re-toss the game piece 10 to him or herself and thereby indicate a second and different action or feeling. The participant would then have to discuss or act out the two actions or feelings together. For example, the participant catches the game piece 10 with his or her right thumb over a patch that corresponds to the feeling "Calm" and then tosses the game piece 10 up and catches it again, this time with his or her right thumb over a patch corresponding to the action "Running." The participant would then would discuss the interaction of running and calmness, such as either the calming effects of running for fun or just a plausibly his reflections on some instance when he was running out of fear away from something and when there was no calm to be had.

EXAMPLE 13

Another specific category of phrases or questions could include questions specific to music, theatre, or drama, in which the surface of the game piece 10 contains patches that correspond to lyrics and the participant has to say what Broadway show it is from, or sing that lyric or the lyrics that follow from the displayed lyric.

EXAMPLE 14

A further embodiment of the present invention is a game piece 10 as described above, but in which specific category of phrases or questions could include questions specific to familial relationships. This game piece 10 has patches corresponding to siblings (brother, sister, step-brother, step-sister, half-brother, half-sister, adopted brother, adopted sister) aunt, uncle, cousin, mother, father, grandmother, and/or grandfather. The game piece 10 or a second game piece 10 could have patches that correspond to feelings, moods, or specific questions regarding specific categories of events.

The participant would then discuss some memory of the displayed family member optionally in conjunction with the displayed mood, feeling or category of event (such as a birthday, a sad time, a first remembered kind gesture, etc.). Alternatively, the interplay could be set up such that instead the participant answers questions or acts out in charades how the person indicated on the ball would answer or act. The other participants would then have to guess which family member or event was being acted out.

EXAMPLE 15

Another specific category of phrases or questions could include questions specific to the context of pre-marital relationships or marriage counseling. This embodiment would contain patches the correspond to issues such as Sex, Money, Children, Communication, Hobbies. Such questions could include, "Do you want Children, and if so when and how many" or "Which family member are you most concerned about and why?"

EXAMPLE 16

Another specific category of phrases or questions could include questions specific to the context of mourning and grief counseling. Grief is a process in which the grieving party passing through a number of stages. Oftentimes, a grieving child has difficulty in passing through these stages even while having the ability and desire to re-establish game playing and interaction with his or her peers and adults. The grief ball can help the therapist to determine where the child is along that often long process of grieving, as well as help the child to act out his or her grief, fear, and concerns. The grief ball could have patches corresponding to a specific set emotions and/or questions tailored to elicit interaction from the grieving participant(s).

EXAMPLE 17

Another embodiment of the present invention includes one or more game pieces 10 whose surface is comprised of a material suitable for clinging to a wall or a receiving board, such as Velcro patches or Velcro strips between the game piece 10 patches, or other sticky material or devices, such a suction cups, etc. The game piece(s) 10 then could be tossed or thrown at a wall or a board such as a circular board common to dart games and the like.

While the present invention has been described with regards to particular embodiments, it is recognized that additional variations of the present invention may be devised without departing from the inventive concept. The important aspect of each of the above-described embodiments is that the Interaction Ball(s) 10 are directed to the instigation of meaningful interaction between therapist and patient or among the participants in a variety of social settings wherein social interaction is otherwise difficult or inhibited. Another goal of the invention is to make such instigation itself of the interaction feel natural and accessible to a wide variety of participants.

EXAMPLE 18

Another embodiment of the present invention includes one or more game pieces 10 whose surfaces comprise topics for initiating and driving a story. The participants may detect a topic or topics from the game piece(s) 10 and creatively tell a portion of a story and would then toss the game piece(s) 10 to another participant in the group who will continue the story according to the topics displayed upon receiving the game pieces 10. Thus, the participants in the group create a story that may be illuminating to the therapist regarding the state of mind of one or more of the participants.

EXAMPLE 19

Another embodiment of the present invention includes specific categories of phrases pertaining to the context of religion. The patches could thereby correspond to different names, phrases or concepts in the Bible, the Koran, or other religious teachings. The participants would be induced to discuss these topics in the therapy setting, participants could work out their disagreements or misunderstandings of another's religion, or ease tensions in a group involving more than one religion. In the parlor game setting, this embodiment of the invention can be used to 'break the ice' with respect to such topics as religion.

What is claimed is:

1. A method for promoting interaction between human participants, comprising the steps of:

bringing together two or more human participants, designating at least one participant, causing a game piece to display one of a plurality of distinct patches, and initiating interaction by requiring the at least one participant to discuss a topic corresponding to said displayed patch wherein said game piece is tossed to a participant in order to cause the game piece to display said displayed patch, and wherein the display of the displayed patch is caused by the manner in which the catching participant catches the game piece.

2. The method as defined by claim 1, wherein said game piece is tossed to one of the said at least one designated participant.

3. The method as defined by claim 1, wherein said game piece is rolled in order to cause the game piece to display said displayed patch.

4. The method as defined by claim 1, wherein the display of the displayed patch is cause by the manner in which the game piece comes to rest.

* * * * *